US005591790A

United States Patent [19]

Lock

[11] Patent Number: 5,591,790

[45] Date of Patent: Jan. 7, 1997

[54] ABSORPTIVE DRESSINGS

[76] Inventor: Peter M. Lock, 43 Bimini Cove Dr., Ocean Ridge, Fla. 33435

[21] Appl. No.: 488,206

[22] Filed: Jun. 7, 1995

Related U.S. Application Data

[63] Continuation of Ser. No. 316,941, Oct. 3, 1994, Ser. No. 903,904, Jun. 25, 1992, Pat. No. 5,382,609, Ser. No. 428, 630, Apr. 25, 1995, and Ser. No. 904,187, Jun. 25, 1992, Pat. No. 5,451,467.

[30] Foreign Application Priority Data

Jun. 26, 1991 [GB] Great Britain ..... 9113861

[51] Int. Cl.[6] ..... C08L 1/00; C08L 1/26; B05D 1/12; D04H 1/58

[52] U.S. Cl. ..... 524/35; 524/43; 524/45; 524/72; 427/180; 156/283; 428/288; 428/290; 428/311.7; 428/311.9

[58] Field of Search ..... 524/35, 43, 45, 524/72; 427/180, 207.1, 208.2; 156/283; 428/532, 283, 288, 290, 311.7, 311.9, 393, 533

[56] References Cited

U.S. PATENT DOCUMENTS

| | | | |
|---|---|---|---|
| 2,686,141 | 8/1954 | Sawyer | 154/101 |
| 2,810,426 | 10/1957 | Till et al. | 154/27 |
| 2,988,469 | 6/1961 | Watson | 154/101 |
| 3,275,496 | 9/1966 | Sponsel | 162/101 |
| 3,622,422 | 11/1971 | Newman | 156/306 |
| 3,813,466 | 5/1974 | Anderson | 424/28 |
| 4,166,464 | 9/1979 | Korpman | 128/287 |
| 4,646,730 | 3/1987 | Schonfeld et al. | 728/156 |
| 4,702,947 | 10/1987 | Pall et al. | 428/36 |
| 4,705,809 | 11/1987 | Dighton et al. | 521/61 |
| 4,818,598 | 4/1989 | Wong | 428/284 |
| 4,988,345 | 1/1991 | Reising | 604/368 |
| 5,063,492 | 11/1991 | Miller | 424/445 |
| 5,064,492 | 11/1991 | Friesch | 156/191 |
| 5,230,959 | 7/1993 | Young, Sr. et al. | 428/372 |
| 5,378,528 | 1/1995 | Makoui | 428/219 |
| 5,382,609 | 1/1995 | Lock | 524/35 |

FOREIGN PATENT DOCUMENTS

| | | |
|---|---|---|
| 427362 | 8/1972 | Australia . |
| 0007149 | 1/1980 | European Pat. Off. . |
| 2031720 | 11/1970 | France . |
| 2031719 | 11/1970 | France . |
| 1259085 | 1/1972 | France . |
| 1259084 | 1/1972 | France . |
| 2416535 | 8/1979 | France . |
| 827641 | 2/1960 | United Kingdom . |
| 2015253 | 9/1979 | United Kingdom . |
| WO81/03265 | 11/1981 | United Kingdom . |
| 2115702 | 9/1983 | United Kingdom . |

*Primary Examiner*—Paul R. Michl
*Assistant Examiner*—LaVonda R. DeWitt

[57] ABSTRACT

The present invention relates to absorptive dressings which are highly absorbent and which retain moisture, said dressings comprising cross-linked cellulosic fibers wherein the cross-linker has been blended with the fibers after electrostatically charging the fibers, the retentive membrane being a layer of thermoplastic which has been laminated onto the dressing at its glass transition temperature, thereby giving the membrane selective moisture permeability properties.

8 Claims, 1 Drawing Sheet

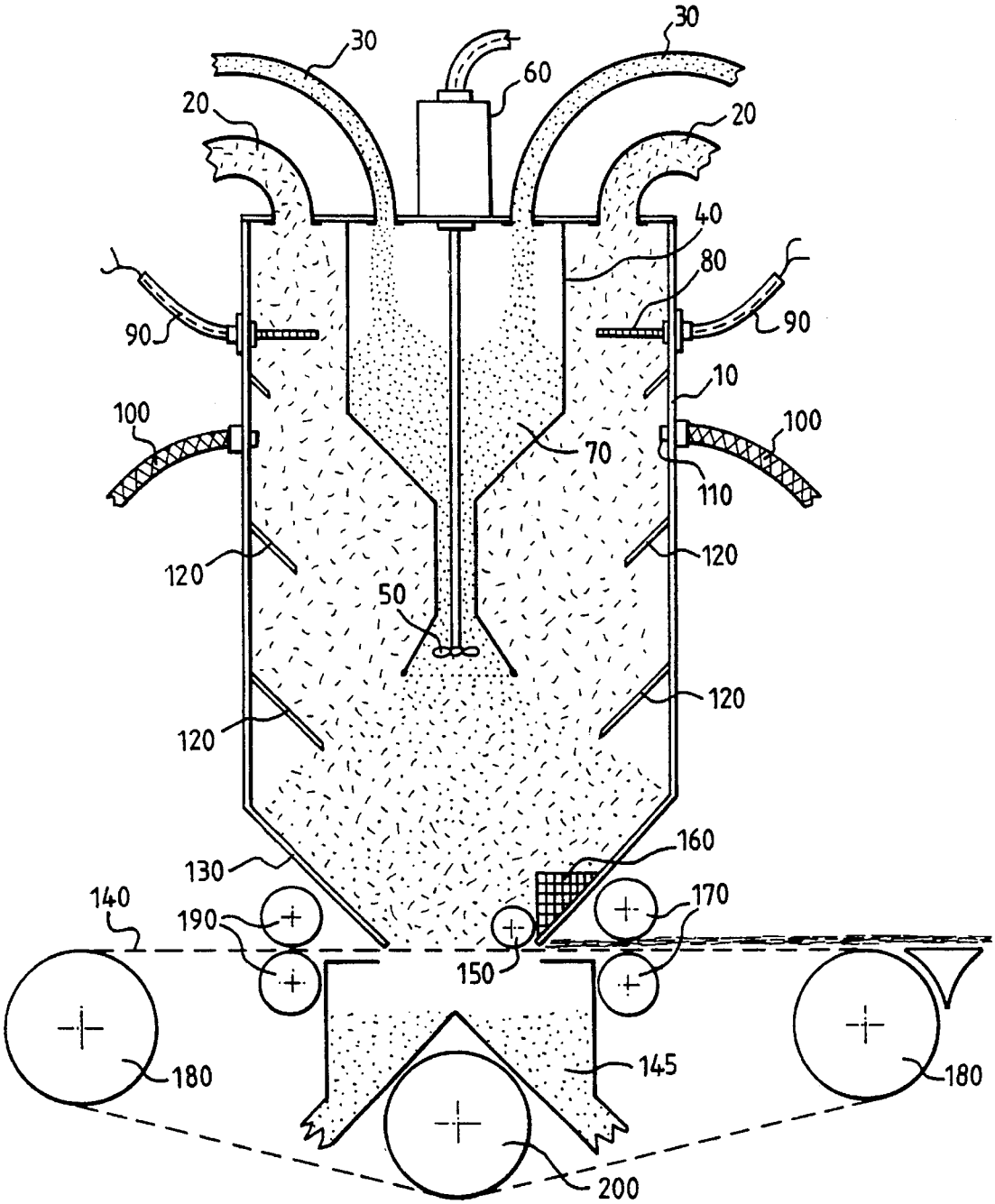
30
30
60
20
20
40
80
90
90
10
100
100
70
110
120
120
50
120
120
160
130
140
190
170
150
180
145
180
200

ABSORPTIVE DRESSINGS

This application is a continuation application of U.S. patent application Ser. No. 08/316,941, filed Oct. 3, 1994 and of application Ser. No. 07/903,904 filed Jun. 25, 1992, now U.S. Pat. No. 5,382,609 and is also a continuing application of application Ser. No. 08/428,630, filed Mar. 25, 1995 and application Ser. No. 07/904,187, filed Jun. 25, 1992 now U.S. Pat. No. 5,451,467.

BACKGROUND OF THE INVENTION

The present invention relates to sheets of fibrous material, especially comprising cellulosic fibers, which are absorbent for aqueous liquids, and which are protected on at least one side by a membrane of permeable plastic.

There is great demand for materials which are capable of absorbing quantities of liquid, while remaining substantially solid, and which, before use, are compact. Examples of uses for such materials include kitchen rolls, sanitary pads, nappies, plasters and wound dressings in general.

Various materials are known which can be used for the above applications. Such materials include foamed plastics, absorbent paper and, more recently, sheets of cross-linked cellulosic fibers.

However, materials which are generally considered suitable do not necessarily fulfil all of the requirements for the application for which they are intended. For example, sanitary pads may be too bulky or too solid, and surgical dressings do not absorb, or do not absorb at a sufficient rate, a sufficient quantity of exudate from the wounds.

An added complication is that, for applications involving contact with the human or animal body, especially a wound, it is highly desirable that there be no toxic compounds present in the dressing which may affect the body in any way. This is a particular disadvantage of many plastics.

Materials which find general acceptance for most of the above-described applications comprise an interlinked, or cross-linked, disperse layer of a fibrous substance, such as cellulose, which has been so treated as to be able to absorb liquids. For example, EP-A-252650 discloses a material made of stiffened curled cellulosic fibers, while EP-A-7134 discloses a fibrous cellulosic sheet, the fibers being bibulous cellulosic fibers and/or sodium carboxymethyl cellulose fibers. These are cross-linked by wetting and applying heat and pressure.

One advantage of the cross-linked cellulosic fibers is their non-toxicity, provided that the cross-linker is a suitable non-toxic compound, such as carboxymethyl cellulose. These materials also have the advantage of being able to absorb up to about one hundred times their own weight in water.

A disadvantage of the cross-linked cellulosic materials arises through the various methods of production available for them. So far, no method for their production has been described which provides a highly absorbent matrix, the maximum being about 100× the mass of the matrix. This is essentially because of the difficulties involved in evenly distributing the cross-linker precursor throughout the fibers before effecting cross-linking. Two basic methods are known for the production of such matrices, the first of which is a dry process, and the second is a wet slurry process.

In the dry process, a layer of suitable cellulosic fibers is generated, such as by the air-felt process, followed by dredging a suitable powdered cross-linker onto the sheet and then compressing the whole, optionally after agitation, together with heating. It is generally necessary to use great pressure in order to effect any kind of satisfactory permeation of the cross-linker through the sheet, and the result is a very densely compressed sheet with variable concentrations of cross-linker throughout. These sheets tend to be least absorbent.

The alternative, wet process involves making a slurry of the cellulosic fibers and the cross-linker. This slurry is dried out and formed into a sheet, and then compressed and heated as before. This results in a more even distribution of the cross-linker throughout the material, but still does not form an optimal material with a particularly even density of cross-linker throughout, and also suffers from the drawback of being time consuming. The main problem is clumping with materials prepared from slurries, even where relatively low quantities of cross-linker are used.

Still further problems arise. While, for some applications, it is suitable to apply the material directly to the area where it is required to absorb liquid, this is, as a rule, undesirable for the treatment of wounds, as the fibers may irritate, or penetrate the wound, or both. In addition, exposed fibrous matrices, especially those containing wound exudates, can provide an ideal environment for the reproduction of bacteria.

To overcome such problems, articles comprising such materials generally further comprise protective membranes. In such instances, it is common to have an impervious membrane on the side of the material not intended for absorption, while a porous membrane is provided on the absorptive side. Well known examples of this type of application include nappies and sticking plasters.

Whilst it is relatively easy to provide a porous membrane to allow the cross passage of liquids, problems arise in preventing backflow of the liquids. In sticking plasters, for example, the porous membrane characteristically comprises an impervious plastics film with many small perforations, but this can allow backflow of the exudate which generally results in the plaster becoming embedded in the wound and, when the plaster is removed, reopening the wound, readily leading to the production of scar tissue.

SUMMARY OF THE INVENTION

It is an object of the present invention to provide an improved process for the production of dressings of membrane coated, cross-linked cellulosic fibrous materials, which process will ensure that the materials have an even and consistent density of cross-linker throughout, and which will not suffer the problems of flowback.

It is also an object of the invention to provide such dressings which display superior absorption properties to the known materials.

It is a further object of the invention to provide dressings having air and vapor permeable membranes but which are not also water permeable, as well as to provide processes for the preparation of such dressings. It is a yet further object of the invention to provide dressings having both of the above types of membrane.

It has now been discovered that it is possible to provide such dressings with superior absorption characteristics and which will retain wound exudates, by the lamination of a thermoplastic sheet onto an absorbent material at or around the glass transition temperature of the thermoplastic, and by the use of static electricity to distribute the cross-linker through the fibers before effecting cross-linking.

Thus, the present invention provides, in a first aspect, a process for the production of dressings comprising an absorbent fibrous matrix coated on at least one side with a layer of porous plastic, the matrix comprising fibers cross-linked with a suitable cross-linker therefor, characterised by the steps of:

(i) charging either of the fibers or cross-linker, or both;

(ii) blending the fibers and cross-linker;

(iii) preparing a layer of the fibers and cross-linker;

(iv) heating and compressing, in either order or together, the layer thereby prepared so as to effect cross-linking of the fibers; and, thereafter or simultaneously therewith (v) laminating a thermoplastic layer onto the surface of the matrix at, or around, the glass transition temperature of the thermoplastic;

and wherein, before the application of step (i), both of the fibers and the cross-linker are essentially dry, the cross-linker being in the form of a fine powder.

BRIEF DESCRIPTION OF THE DRAWING

The accompanying FIGURE shows apparatus suitable for the production of an absorbent layer of the invention.

DETAILED DESCRIPTION OF THE INVENTION

In the present context, "glass transition temperature" is used to indicate that temperature, or range of temperatures, at which a thermoplastic begins to flow, and is distinct from the melting point of the thermoplastic. In particular, "at or around" is used to indicate that range of temperatures beginning with the glass transition point and ending at or below the melting point of the thermoplastic.

Although the preferred lamination temperature is below the melting point of the thermoplastics, it will be appreciated that, under certain circumstances, it will be possible to laminate the thermoplastics at, or slightly above, the melting point of the thermoplastic, provided that the treatment is sufficiently rapid that the thermoplastic only flows for a very short period of time, so that the membrane does not disintegrate.

The process of the invention gives rise to an extremely even coating of cross-linker on the fibers, and the composite layer of fibers and cross-linker can then easily be compressed and heated to yield a superior end product. Furthermore, the process is extremely easy to use and effect, and is also cheap and quick, not requiring heavy compression rollers, or time consuming drying of a slurry.

A further advantage lies in the hygienic method of preparation of the product, as the constituents and process are essentially dry, thereby limiting the possibility of contamination.

In the process of the invention, it is generally preferred that the preparations are brought into admixture in a gaseous medium, preferably air.

Before compression, it is desirable to allow the mixture to settle into a layer after first bringing the preparations into admixture in a drum with agitation.

It is generally preferred that the fibers be suspended in air in a suitable container, such as a polyethylene or polypropylene drum, and charged. It is sufficient, for example, to merely provide a quantity of fibers in a polyethylene bag, to inflate the bag, and then to shake or agitate the bag so as to charge the fibers. Once this has occurred, the powdered cross-linker can be introduced to the bag and shaken again, after which the bag can be emptied onto a suitable surface, and the resulting layer heated and compressed.

On a larger scale, the fibers could be provided in a drum which, in turn, could be rotated until such time as the fibers therein were sufficiently charged. The cross-linker could then be introduced, with the drum rotated further, and then the mixture allowed to settle into the composite layer.

The fibers may also be charged by other suitable means, such as providing charging plates directly linked to an electrical source, or by using ionizing radiation. It is also not necessary to suspend the fibers in air, especially if either of these latter two methods is used, and the powdered cross-linker can be introduced to the layer of fibers which then need only be agitated sufficiently to allow an even distribution of the cross-linker throughout the fibers, the electrical charge on the fibers serving to attract the cross-linker.

The present invention provides apparatus for the production of absorbent materials from an essentially dry preparation of fibers and an essentially dry preparation of a powdered, heat activatable cross-linker for the fibers, the apparatus comprising a drum having a top, a bottom and walls defining a cavity of the drum;

the top of the drum having a first at least one opening through which the fibers can be introduced;

the top of the drum having a second at least one opening through which the cross-linker can be introduced;

dividing means being located between the first and the second openings, the dividing means extending toward the bottom of the drum, and preferably forming a funnel;

electrical charging means being provided on the wall of the drum at a position below the first at least one opening and above the lowest extent of the dividing means;

means for introducing gas under pressure being provided on the wall of the drum at a position below the first at least one opening and above the lowest extent of the dividing means;

means, such as a propellor or fan blade, to disperse the cross-linker and the fibers to form a dispersion when the cross-linker falls below the lowest extent of the dividing means;

the bottom of the drum defining an opening through which the dispersion can pass;

a fine mesh conveyor being located beneath the bottom of the drum to collect the dispersion;

collecting means being disposed beneath the conveyor to collect any excess cross-linker falling through the conveyor;

means to heat the dispersion after collection on the conveyor; and means to compress the dispersion after collection on the conveyor, the heating and compressing means optionally being provided together in one or more rollers, for example.

It is also not necessary for the fibers to be charged. It is possible for the powdered cross-linker to be charged instead, and then introduced to a suitable preparation of the fibers. Again, this may be a suspension in air, or may be a layer of fibers which are then agitated after the introduction of the cross-linker.

It is also possible to charge both the cross-linker and the fibers, but this is not required, and may possibly result in clumping of the cross-linker on the fibers if too much cross-linker is introduced.

It is also preferred to allow excess cross-linker to be separated from the composite layer before heating and compression. This may be effected by depositing the layer on a fine mesh, thereby allowing excess powder to fall through, and be collected for further processing if desired. Owing to the charged nature of the layer and the powder, it may also be desirable to earth any container into which the powder falls. It is not so desirable for the mesh, as it may serve to prematurely discharge the composite layer, and allow the cross-linker to fall away from the fibers. In such an instance, an inferior product may be formed. However, it is generally the case that the charged condition of the composite layer exists for several minutes, allowing unhurried preparation of the layer for heating and compression before the charge wears off.

In some cases, it may be desirable to align the fibers in the material, and this may be achieved by any suitable means. One such means is by combing the material, such that the fibers must pass through a suitable array of slots, for example.

Regarding the membrane(s), it will be appreciated that, for different thermoplastics, the range of temperatures at which the process can be carried out varies. For example, a preferred thermoplastic comprises a blend of hydroxypropyl cellulose and carboxymethyl cellulose (this combination is readily biodegradable, relative proportions determining relative rate of degradation), and the glass transition point of this blend is very close to its melting point and, for a substantially even (50/50) blend, the temperature at which the process can be carried out is effectively limited to about a temperature of 352° F. (178° C.). By way of contrast, if these two substituents are mixed further with polyethylene, again in an even amount, the lamination can be effected at anything between about 149° to about 177° C.

Such a blend of the three thermoplastics is a particularly preferred embodiment of the present invention, and has particularly good moisture retention properties as described hereinbelow. Thinner laminates of this material are particularly useful in permitting unidirectional passage of water toward the absorbent material, but not away from the absorbent material, while thicker laminates do not permit passage of water but do permit passage of vapor.

Thus, it will be appreciated that essentially any thermoplastic may be used, provided that it is laminated onto the absorbent material at its glass transition temperature.

As used herein, the term "thermoplastic" relates to those polymers, or blends of polymers, which are able to form a thin flexible film, such that they may be introduced to the surface of the absorbent material and conform to the surface thereof in a manufacturing process without cracking or snapping, and which melt at higher temperatures.

Accordingly, many materials are incorporated within the definition of "thermoplastic", and generally include such substances as polyhydroxymethyl methacrylate, polypropylene, polyurethane, polystyrene, polyethylene and such substances as substituted polysaccharides, where these fall within the definition of thermoplastic as provided above. In particular, preferred substituted polysaccharides include carboxymethyl cellulose and hydroxypropyl cellulose.

The membranes of the present invention may be of any desired thickness. However, it is necessary that the entire membrane be laminated onto the absorbent material under such circumstances, and in such a way that the entire thickness of the thermoplastic reaches the glass transition temperature. Accordingly, the thickness of the membrane is effectively limited in practice, as a general technique for laminating the membrane onto the absorbent material is to use at least one pair of rollers, the one which is intended to come into contact with the thermoplastic being heated. Thus, if the lamination takes an excessive amount of time owing to the thickness of the thermoplastic, it is quite likely that the surface of the thermoplastic will start to melt before the inner face of the thermoplastic has reached the necessary temperature.

The thickness of the thermoplastic membrane will also determine the properties of that membrane. Thicker membranes will not be water permeable, but will tend to be gas and vapor permeable, much along the lines of human skin. However, what is most surprising is that the thinner membranes formed by this process permit preferential passage of water, or other liquids, toward the absorbent material. In fact, this tends to be so marked, that the passage of water is effectively one-way, so that water can readily pass into the absorbent material, but cannot return. This is a very marked advantage of the present invention, and represents a preferred embodiment.

The thicknesses of the membranes which give rise to the above two types of embodiment cannot be absolutely defined, as they are dependent on the nature of the thermoplastic involved. Nevertheless, as a general guide, very low density thermoplastics have been found to provide good water permeable membranes. For example, low density polyethylene (LDPE) may have a density as low as 15 g $m^{-2}$, although densities up to around 25 g $m^{-2}$ will also suffice.

Densities of about 25 g $m^{-2}$ up to about 35 g $m^{-2}$ LDPE will tend to provide water impermeable, but gas and vapor permeable, membranes.

On its own, LDPE is not preferred, although it will provide membranes as required. A particularly preferred thermoplastic is polyhydroxymethyl methacrylate, although this tends to be somewhat expensive to manufacture.

What has been found to be most preferable, from a point of view of ease of manufacture and final properties, is a blend of a less hydrophilic thermoplastic with a more hydrophilic thermoplastic. Thus, a blend of LDPE and carboxymethyl cellulose (CMC) has been found to be particularly useful. It may be conjectured that the less hydrophilic thermoplastic forms a matrix supporting the more hydrophilic thermoplastic, such that exposure to water causes a rupture between the two, and that back pressure of the liquid presses the two back together, although the present invention is not limited by such conjecture.

Where two or more different thermoplastics are employed to form the one membrane, then it is preferred to blend them before applying them to the absorbent material. In particular, it is preferred to roll sheets of the thermoplastics together at or around a mutual glass transition temperature to provide a single layer of a thermoplastic blend. For example, a blend of hydroxypropyl cellulose, carboxymethyl cellulose and low density polyethylene may be achieved at temperatures of between 149° to about 177° C. (300° F. to 350° F.) The same temperature may be used to laminate the film onto the absorbent material.

The temperatures involved in achieving the desired effects can, in practice, be affected by the conditions prevalent. Thus, it is preferred to carry out the process under conditions of about 6 to about 8% humidity, and preferably at about 75° F. (about 24° C.). In addition, it has been found that a suitable pressure, both for pressing together several sheets of thermoplastic, and for laminating the thermoplastic onto the absorbent material, is about 15 lbs $in^{-2}$ (about 100 kP).

When rollers are used to press the films together, the rates will vary according to the thickness of the film and the temperature of the rollers. In practice, the temperature of the rollers will tend to be slightly above the glass transition temperature of the plastics, but will not be too far above, in order to prevent the plastics melting. A differential of a few degrees is suitable. Where a thin layer is being compressed before being laminated onto the absorbent material, this can be done at roller speeds (where both rollers are heated) of up to around 1 m $min^{-1}$. Where such a layer is being laminated onto the absorbent material, the rate will necessarily be slower, as only one heated roller will have an effect on the membrane, so that speeds will necessarily be reduced to, for example, around 0.25 m $min^{-1}$. For the thicker membranes, these speeds will be reduced by about a factor of 4. All of these conditions should be taken into account when laminating a thicker membrane on one side of the absorbent material and a thinner membrane on the other side of the absorbent material, although it is possible in practice, and preferable, to laminate both layers onto the absorbent material at the same time.

It will be appreciated that only one membrane needs to be applied to the absorbent material, and that it may be of either variety as defined. However, it is generally preferable that two membranes be provided on any type of absorbent material, but it is not necessary that both membranes be both types of membrane as defined herein, or that more than one of the membranes be a membrane of the invention. For example, in the case of a nappy, the water permeable membrane of the invention may be provided on the one side of the material, while a solid layer of plastic be provided on the other. Alternatively, instead of a solid layer of plastic, a woven material impregnated with a water impermeable substance may be provided, for example.

The matrix on which the thermoplastic is layered should have a sufficiently continuous surface such that lamination of the thermoplastic results in effectively continuous contact between the membrane and the absorbent material.

Other treatments of the composite matrix layer may comprise spraying or immersion of the layer with water or any other, suitably aqueous, liquid, followed by drying which may be effected at the same time as the heating and compression. Such a treatment affects the end product, but is not usually desirable, unless, for example, the spray includes a dye, antiseptic or antibiotic. Even so, such substances may be added after cross-linking.

Before cross-linking, it may also be desirable to run the layer through a series of rollers, such as wet and dry heated rollers. Again, this affects the end product in a known manner.

Returning to the blending process, it is preferred to keep both cross-linker and the fibers as dry as possible, in order to maximise the effect of the electrical charge. To this extent, it may also be preferable to introduce a stream of warm dry air to displace humid air, or to dry the fibers and/or cross-linker. Further, it is not necessary that air is used, although if any other medium, such as an inert gas, or nitrogen, is used, then this will tend to raise the cost of production, and involve more expensive containment facilities. Nevertheless, use of such alternative media is envisaged by the present invention.

The present invention is particularly applicable to cellulosic fibers, but is not limited thereto. Any fibers may be used, provided that they are capable of being electrically charged. In particular, it is preferred that the fibers comprise polyhydric polymers, useful examples of which are naturally occurring structural polymers, particularly polysaccharides. Suitable examples include lignin, and especially cellulose.

It is not necessary that the fibers be bibulous, as it is generally envisaged that the majority of the absorption of the end product will be effected by the cross-linker matrix. However, it is preferred that the fibers be as fine as possible. This is for two reasons, the first being in order to avoid irritation where the material might come into contact with the human or animal body, and the second being to enhance the ability of the fibers to hold an electric charge. Nevertheless, it is envisaged that, provided that the fibers can hold an electric charge, then any gauge fibers may be used.

It is envisaged that, during the blending process, the powder of the cross-linker will evenly coat each individual fiber, subject to the amount of cross-linker present. Accordingly, it is preferred to prepare the cross-linker in such a manner that it forms a very fine dry powder. It is generally preferred that the mesh size of the powder be such that the powder will appear to float if a pinch of the powder is sprinkled in the air. In general, the cross-linking compounds available tend to be somewhat coarse, and it is preferred that they should be milled further before use.

There is no particular restriction on the nature of the cross-linker, provided that it can form a suitably fine powder-for use in accordance with the process of the invention. Suitable cross-linkers may be those that form a gel with water, and examples include such compounds as gum arabic, starch, cellulose, hydroxypropyl cellulose, but especially carboxymethyl cellulose. This last is especially preferred where the end product is to comprise cellulose fibers.

It will be appreciated that the nature of the cross-linker will affect the properties of the end product. Such properties include the quantity of liquid which can be absorbed, as well as the rate at which the liquid is absorbed.

The materials produced in accordance with the present invention tend to have considerably superior absorptive qualities and, for example, a material which comprises essentially cellulose fibers and carboxymethyl cellulose (CMC) as cross-linker can absorb up to about 2,000 times its dry weight.

In the example given above, the rate of absorption tends to be extremely rapid (as little as a few seconds), and this may not always be desirable. If the material is to be used for a burn, for example, where the exudate only emerges slowly, then it may be desirable to tailor the material such that, while the overall capacity for absorbing liquid is substantially unchanged, the rate at which it will absorb the liquid is considerably reduced. Again, in the above example, this is suitably achieved with the addition of hydroxypropyl cellulose to the CMC. A proportion of about 10% hydroxypropyl cellulose to 90% CMC is generally suitable to slow the rate of absorption down such that capacity is only reached after about 24 to 48 hours.

It may also be desirable to provide a blend of substances to form the cross-linker for other reasons. In particular, while CMC is a particularly good absorptive agent, its cross-linking strength is not necessarily particularly high. A material comprising solely CMC and cellulose will hold together, even at full water capacity, but can fairly readily be broken up.

Thus, if required, a further substance can be introduced into the cross-linker powder, or pulve, to enhance the strength of the material. Again, the substance should be finely milled, and does not need to be able to provide an absorbent matrix in its own right. Suitable substances include low density thermoplastics, such as polyethylenes. These may be used in any suitable quantity, but the higher the proportion of the strengthening cross-linker, the lower the final absorptive capacity of the end product will be. A suitable range of strengthening cross-linker in the powder is between about 10% and 30%, with about 20% being preferred. When the layer is heated and compressed, the cross-linking will occur.

After the absorbent material has been prepared, it may be packaged in any suitable manner, or prepared as a dressing or nappy etc.

If the materials of the invention are to be applied as a dressing for a wound, for example, then adhesive may be applied to one face of the material, or to the porous layer which would separate the wound from the absorbent material.

It will also usually be preferable to seal the edges of the material to prevent any leakage of liquid out of the side of the product, and this may be achieved in any known manner, such as by the use of a binder or sealant. One method may involve stitching along the edge followed by sealing the stitching, if required, by a suitable sealant.

Suitable non-limiting examples of uses to which the materials of the invention may be put include: surgical sponges; incontinence pads; pledgets; eye pads; plasters; adhesive surgical dressings; impregnated wound dressings; ischaemic ulcer dressings; decubitus ulcer dressings; burn dressings; emergency accident packs; haemostatic dressings and, generally, human or animal applications.

It will also be appreciated that the absorbent materials of the invention may be employed in industrial situations, and may also useful provide insulation.

In an alternative aspect, there is provided a dressing comprising an absorbent matrix which has, on at least one side thereof, a porous plastic membrane, the matrix comprising fibers cross-linked by a suitable cross-linker, characterised in that the cross-linker is associated with substantially the entire surface of each fiber, and wherein the porous plastic is a thermoplastic and is essentially integral but gas and vapor permeable. By "integral" is meant that there are no macroscopic holes, that is, no holes are visible to the naked eye. The membrane may be coated on the matrix, as described in the Example.

More preferably, the matrix comprises fibers cross-linked by a polyhydric cellulose derivative, and preferred cross-linkers comprise at least 50% carboxymethyl cellulose. It is most preferred that the fibers comprise natural structural polymers, the most preferred being cellulose.

It is preferred that the membrane permits passage of aqueous liquids preferentially towards the layer of absorbent material. There is still further provided such a product wherein the passage of aqueous liquid, such as water, is substantially blocked in the direction away from the absorbent material.

In a preferred embodiment, there is provided a dressing as defined, comprising a membrane as defined on either side, one of which membranes is not permeable to water, and the other of which permits passage of water substantially only in the direction of the absorbent material.

This latter embodiment is particularly preferred, as it permits the passage of fluids into the dressing without allowing egress. Therefore, there is no problem with crusting of the wound exudate, which can effectively render the dressing part of the wound. In addition, owing to the large capacity of the matrix of the invention, the dressing can be left in place for essentially the lifetime of the wound or, if the condition is chronic, such as decubitus ulcers, then little or no changing of the dressing is required.

In this embodiment it is particularly preferred to construct the bottom layer from the lighter weight films such that it permits wound exudate to enter the dressing but, as explained above, not to leave. The top layer is constructed from the thicker film, so as not to permit passage of water in either direction, but to allow the passage of vapor, so that the dressing can "breathe". Thus, this dressing effectively doubles as natural skin, promoting rapid healing. Furthermore, the pores in the lower layer are not of a sufficient size to permit passage of microorganisms, so that this type of dressing is also remarkably clean, and does not tend to become infected in use.

In addition, it is especially advantageous to construct the top layer of two, but preferably one thermoplastic, particularly hydroxypropyl cellulose, while the bottom layer advantageously comprises carboxymethyl cellulose, hydroxymethyl cellulose and polyethylene in equal proportions.

In particular, the membranes of the invention do not tend to adhere to desquamised body surfaces, so that, even when a dressing needs to be removed, this can be done without reopening the wound and with no discomfort to the patient.

The type of dressing may easily be selected according to the condition to be addressed (as used herein, the term "wound" is used to indicate a lesion of the body surface which permits or generates exudates, and may include ulcers, for example). In particular, rapid or slow absorption may be required according to the wound or use.

Burns are particularly treatable by the dressings of the invention, in that they generate a large amount of fluid slowly over a long period. In such instances, the matrix may comprise both hydroxypropyl cellulose and LDPE, as the dressing needs to hold together and to be able to absorb a large amount of fluid slowly.

It has also been discovered that these dressings are not only advantageous in the manner so far described, but that they can also promote extremely rapid wound healing, even in circumstances previously considered to be incurable, such as various types of chronic ulcer.

The reason for such healing promotion appears to be because the combination of retaining fluids in the dressing and the porous nature of the membrane away from the skin generates a warm, moist microclimate, very similar to if skin were actually covering the wound, thereby encouraging migration of the necessary epithelial cells over the lesion.

In circumstances where pledgets need to be used in surgery, the prime consideration is safe absorption of large quantities of fluids, and the present invention can also provide such dressings. In such uses, the matrix preferably comprises only cellulose cross-linked by CMC. Again, a particular advantage of the invention is that the dressing does not need to be changed frequently, as it is capable of absorbing many times more fluid than conventional dressings.

As used herein, the term "dressing" applies to any article of the invention when applied to a bodily surface, whether it be man or animal, and whether or not there is any provision to adhere the dressing in place, or merely to hold against the bodily surface.

In the case of nappies, for example, it may be desirable to incorporate a further layer of water permeable, porous thermoplastic deeper within the matrix to enhance the water retention characteristics of the dressing. Similar considerations would also apply to tampons.

In the accompanying FIGURE, there is shown apparatus for the manufacture of an absorptive sheet of the invention. Drum 10 has fiber and pulve inlets 20, 30, each of which type of inlet may comprise one or more ducts (two are shown). Within drum 10 is reservoir 40, to retain the pulve entering through duct 30. At the bottom of drum 40 is propellor 50, driven by power supply 60. Pulve 70 is shown diagrammatically in reservoir 40.

In drum 10, the fibers are introduced through duct 20, and are charged by electrode 80, attached to power supply 90. Electrode 80 is suitably a circular mesh around the inside of drum 10 and through which the fibers must pass, thereby to be charged.

Compressed air supply 100 has an inlet 110, suitably arranged as a series of nozzles or apertures into drum 10, and acts to disperse the fibers within the drum. The charged, dispersed fibers are then blended with the pulve, through the combined actions of baffles 120, propellor 50 and the compressed air from outlet 110.

The mix settles towards the fine mesh conveyor 140, and is also encouraged towards the conveyor by the action of the compressed air. Once on the conveyor 140, excess pulve is blown through the mesh (it would also tend naturally to settle) and into waste collector 145, while the mix remains on the conveyor.

The mix is then crushed by compression roller 150 and spread/combed by spreader/comber 160. Powered crimp rollers 170 further aid in the final conformation of the absorptive sheet. Subsequently, the sheet may be processed as desired.

In addition, tensioned rollers 180 keep the conveyor 140 tensioned, while guide rollers 190 serve to guide the conveyor as it picks up the mix. Powered roller 200 keeps the conveyor moving.

The accompanying example is intended for illustration only.

EXAMPLE

A) Absorbent Matrix

The components of the absorbent matrix are:

1. Cellulose fibers (CF), staple length 0.3 to 0.5 mm;
2. Carboxymethyl cellulose (CMC) milled to pulve; and
3. LDPE Granules milled to pulve.

The constituents are:

100 g CF;
250 g Blanose CMC (BL); and
150 g LDPE granules milled to pulve.

Ten grammes of fine cellulosic fibers, staple length 0.3 mm, are placed in a hexagonal chamber, preferably made from polypropylene, polyethylene or nylon. The chamber is rotated on a long axis mechanically at speeds between 25 and 45 revolutions per minute, depending on the size of the chamber. In this example the chamber is 20 inches high, 10 inches in diameter and bottle shaped (Bench technique). The rotation agitates the fibers and creates an electrostatic charge to the fibers. the charged fibers are tested at intervals by stopping the rotation and placing a 20 inch plastic rod in the container, to see if the fibers are attracted to it. If they are attracted en masse, a few more minutes of agitation is required before the second phase is employed. The procedure usually takes between 10 and 15 minutes, but is very dependent on the surrounding environment and it may be necessary to introduce warm dry air into the chamber to speed the process.

When the fibers are judged to be correct in terms of the charge they are holding, 25–30 g of very finely ground carboxymethylcellulose (pulve) is introduced into the chamber, preferably through a very fine sieve, so as to form clouds of pulve in the chamber. The rotation is then started again between 5 and 10 revolutions per minute. The CMC pulve is attracted to the charged fibers after approx. 5 minutes, depending on thickness of coating required (different thicknesses of coating are used for different product requirements).

When the fibers are sufficiently coated for the product required, the agitation is stopped and the coated fibers are allowed to settle on a Teflon (Trade Mark) coated fine wire mesh positioned 0.5 inch (13 mm) above a metal alloy tray inserted through an aperture at the bottom of the chamber. The coated fibers are collected on the wire mesh and the unused pulve is allowed to pass through and is collected on the tray beneath. The chamber may need to be earthed to prevent the fibers from clinging to the interior.

The wire mesh is then removed with the fibers from the chamber and gently agitated so that the fibers lie flat on the mesh. A duplicate fine wire mesh is then gently laid on the exposed fibers, to sandwich them. The sandwich is then passed through a pair of preheated Teflon (Trade Mark) coated rollers, to effect cross-linking. The fine wire mesh is then removed from the fibers to leave a pad of material.

Thickness may be gauged by the weight of the fibers and CMC pulve introduced into the chamber. The rollers may be heated electronically to produce variable heat for different thicknesses. The temperatures required are usually between 300° F. and 400° F. (149° and 204° C.). Roller pressures are between 10 and 20 lb per square inch, speed of rollers is between 45 seconds and 60 seconds per square yard.

If necessary, the cellulose fibers may be positively charged and CMC negatively charged, thereby speeding the process and producing a better base material.

B) Lamination of Porous Membranes

The outer membrane of the dressing will be gas and vapor permeable, but water resistant. In order to achieve this in the present case, the membrane is prepared prior to lamination on the matrix prepared in A) above.

A triple laminate to form the outer membrane is prepared and comprises:

1. Low Density Polyethylene film (LDPE);
2. Polyhydroxypropyl cellulose film (KLUCEL—KL); and
3. Carboxymethyl cellulose film (Blanose—BL).

The specifications are:

LDPE—BOWATER, DUPONT 30 gm $m^{-2}$ film.
KL—AQUALON, HERCULES 25 gm $m^{-2}$ film.
BL—AQUALON, HERCULES 20 gm $m^{-2}$ film.

The films were laminated together at a temperature of 350° F. (177° C.) between heated, polytetrafluoroethylene coated rollers, at a pressure of 15 lb $in^{-2}$ (100 kP), at a rate of 0.5 m $min^{-1}$.

The inner membrane is a double, water permeable laminate consisting of:

1. LDPE—15–20 g $m^{-2}$ (Bowater, Dupont);
2. CMC film (BL)—15–20 g $m^{-2}$ (Aqualon);

Lamination is as before at a temperature of 300° F. (149° C.) between two heated, polytetrafluoroethylene rollers, at a pressure of 15 lb $in^{-2}$ (100 kP), at a rate of 1 m $min^{-1}$.

The outer membrane and inner membrane are then laminated onto the matrix prepared in A) above, at 350° F. (177° C.) between two heated, polytetrafluoroethylene rollers, at a pressure of 15 lb $in^{-2}$ (100 kP), at a rate of 0.25 m $min^{-1}$, to form a sandwich.

The finished material is then passed through a heated roller cutter and is cut to the various shapes and sizes required for the product.

I claim:

1. A dressing comprising an absorbent fibrous matrix having on at least one side a layer of porous plastic, said matrix comprising fibers joined by a suitable heat activatable compound therefor, said heat activatable compound being associated with substantially the entire surface of each fiber, and wherein said layer of porous plastic is a thermoplastic and is essentially integral but gas and vapor permeable.

2. The dressing of claim 1 wherein said layer permits passage of aqueous liquids preferentially towards said matrix and wherein passage of aqueous liquid is substantially blocked in the direction away from said absorbent material.

3. The dressing of claim 1 wherein said matrix has said layers on both sides, said layer on one side being not permeable to water and, on the other side, said layer permitting passage of water substantially only in the direction of said absorbent material.

4. The dressing of claim 1 wherein said fibers are cellulose.

5. The dressing of claim 1 wherein said heat activatable compound is selected from the group consisting of gum arabic, starch, cellulose, hydroxypropyl cellulose and/or carboxymethyl cellulose.

6. The dressing of claim 1 wherein said fibers comprise cellulose fibers and said heat activatable compound is carboxymethyl cellulose.

7. The dressing of claim 1 wherein said heat activatable compound further comprises between 5 and 20% hydroxypropyl cellulose and a low density thermoplastic in a quantity between about 10% and 30%, the remainder being cellulose.

8. A dressing comprising an absorbent fibrous matrix, said matrix comprising fibers held together by a suitable heat activatable gel former therefor, said heat activatable gel former being associated with substantially the entire surface of each fiber, said matrix further having a first thermoplastic membrane on one side and a second thermoplastic membrane on the other side, said first membrane being impermeable to water, and said second membrane permitting passage of water substantially only in the direction of said absorbent material, said first membrane consisting essentially of hydroxypropyl cellulose, and said second membrane consisting essentially of carboxymethyl cellulose, hydroxymethyl cellulose and polyethylene in equal proportions.

* * * * *